US009236199B2

(12) United States Patent
Taniguchi et al.

(10) Patent No.: US 9,236,199 B2
(45) Date of Patent: Jan. 12, 2016

(54) SWITCH

(71) Applicant: OMRON Corporation, Kyoto-shi, Kyoto (JP)

(72) Inventors: Akio Taniguchi, Kurayoshi (JP); Yasuhiro Kiyono, Nagaokakyo (JP)

(73) Assignee: OMRON Corporation, Kyoto (JP)

( * ) Notice: Subject to any disclaimer, the term of this patent is extended or adjusted under 35 U.S.C. 154(b) by 201 days.

(21) Appl. No.: 13/898,399

(22) Filed: May 20, 2013

(65) Prior Publication Data

US 2013/0319839 A1 Dec. 5, 2013

(30) Foreign Application Priority Data

May 22, 2012 (JP) ..... 2012-116248

(51) Int. Cl.

| | |
|---|---|
| ***H01H 1/20*** | (2006.01) |
| ***H01H 13/12*** | (2006.01) |
| ***H01H 1/24*** | (2006.01) |
| ***H01H 13/52*** | (2006.01) |

(52) U.S. Cl.

CPC ..... *H01H 1/20* (2013.01); *H01H 1/242* (2013.01); *H01H 13/12* (2013.01); *H01H 13/52* (2013.01)

(58) Field of Classification Search

CPC ..... H01H 1/242; H01H 1/245; H01H 13/12; H01H 13/20; H01H 13/52

USPC ..... 200/276.1, 16 C, 276, 532, 342

See application file for complete search history.

(56) References Cited

U.S. PATENT DOCUMENTS

| | | | | |
|---|---|---|---|---|
| 3,924,089 | A * | 12/1975 | Abernethy | 200/532 |
| 4,972,056 | A * | 11/1990 | Wu | 200/276.1 |
| 2005/0167253 | A1 * | 8/2005 | Nakade et al. | 200/270 |

FOREIGN PATENT DOCUMENTS

| | | |
|---|---|---|
| EP | 2 009 318 A1 | 12/2008 |
| JP | 04-022500 | 5/1992 |
| JP | 06-015232 | 2/1994 |

* cited by examiner

*Primary Examiner* — Renee Luebke
*Assistant Examiner* — Ahmed Saeed
(74) *Attorney, Agent, or Firm* — Klarquist Sparkman, LLP

(57) ABSTRACT

This invention provides a switch including a housing, a plunger that slides in a press direction or a return direction with respect to the housing, a return spring that biases the plunger in the return direction and is compressed by a slide of the plunger in the press direction, a plurality of terminals that are brought into a conductive state according to a predetermined position of the plunger, and a terminal contact spring that makes contact with the terminals so as to bring the terminals into a conductive state by the slide of the plunger in the press direction. The terminal contact spring is disposed so as to be compressed according to the slide of the plunger in the press direction under a contact state of making contact with the terminals.

5 Claims, 12 Drawing Sheets

ENLARGED CROSS SECTIONAL VIEW ALONG A-A LINE

ENLARGED CROSS SECTIONAL VIEW ALONG B-B LINE

FIG. 4A1
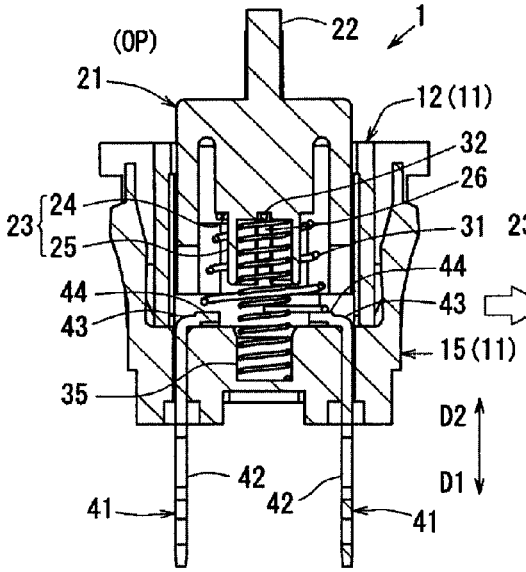
FIG. 4A2
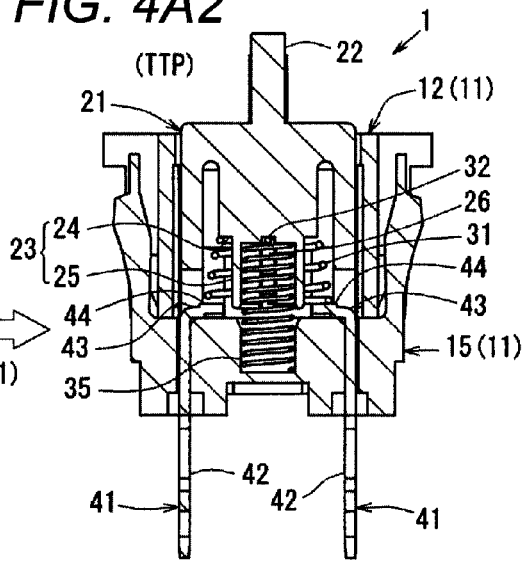
FIG. 4B1
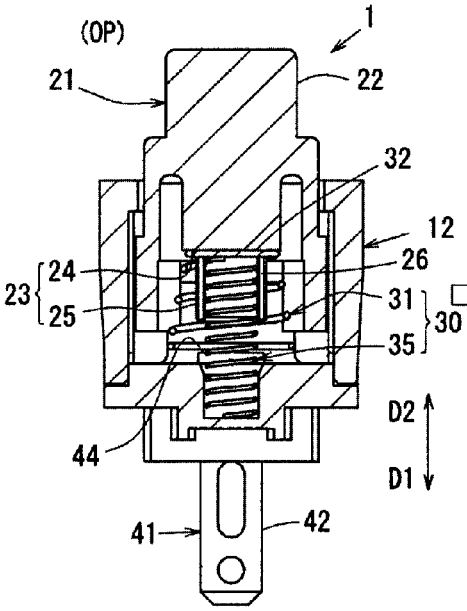
FIG. 4B2
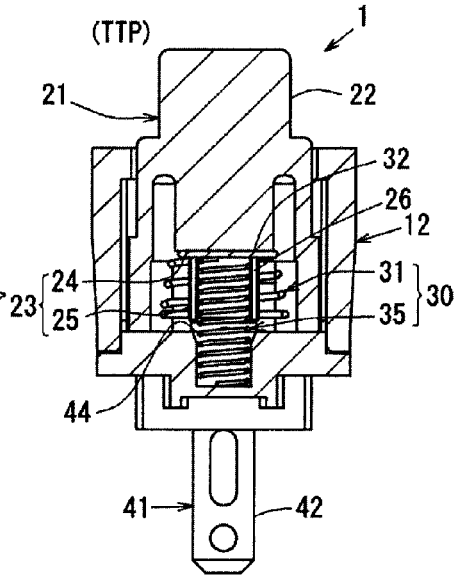

ENLARGED CROSS SECTIONAL VIEW ALONG C-C LINE

ENLARGED CROSS SECTIONAL VIEW ALONG D-D LINE

FIG. 8A1
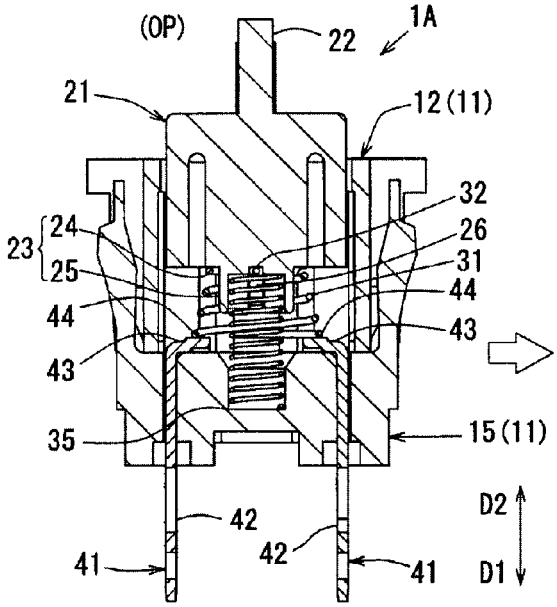
FIG. 8A2
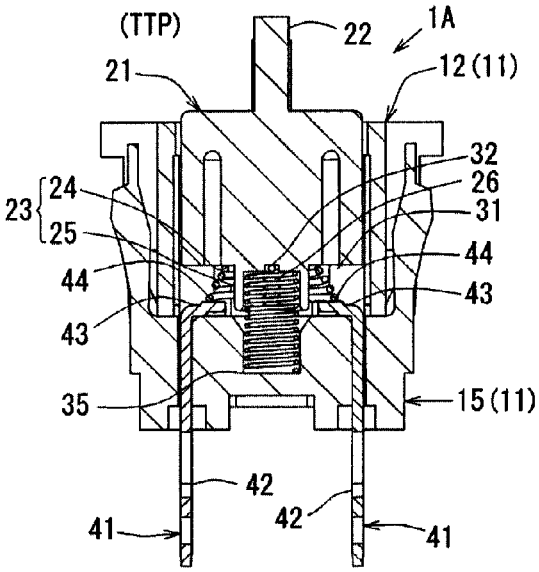
FIG. 8B1
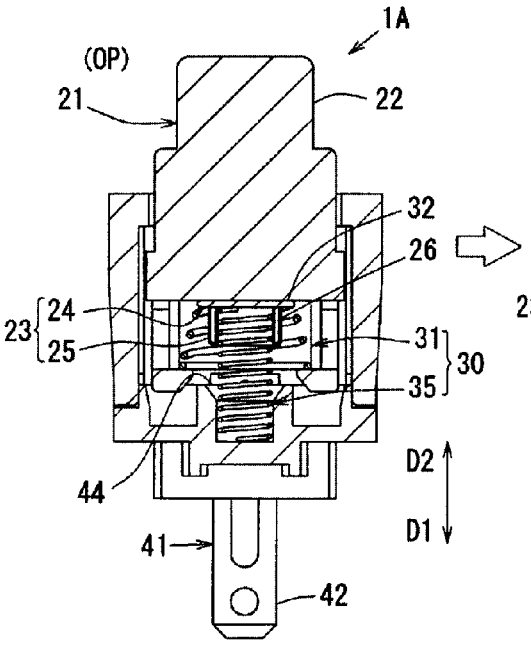
FIG. 8B2
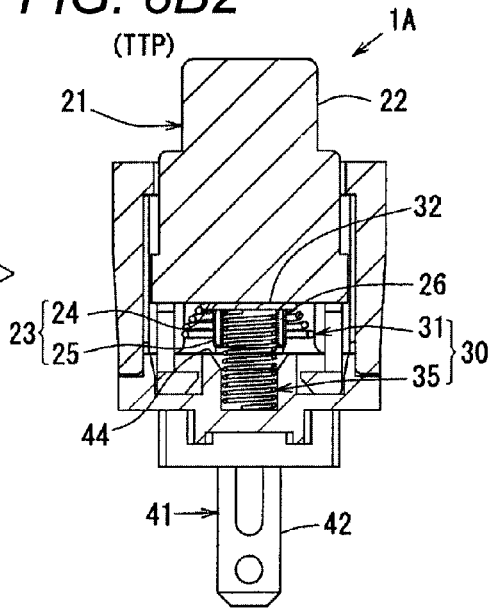

ENLARGED CROSS SECTIONAL VIEW ALONG E-E LINE

ENLARGED CROSS SECTIONAL VIEW ALONG F-F LINE

SWITCH

CROSS REFERENCE TO RELATED APPLICATION

This application claims benefit of priority to Japanese Patent Application No. 2012-116248, filed on May 22, 2012 of which full contents are added by herein.

BACKGROUND OF THE INVENTION

This invention relates to a switch which is required to meet specifications having high contact reliability, such as a switch which is built in a controller button of a game machine.

In convention, as a switch of a type whose contacts are brought into a conductive state by pressing a plunger, for example, various switches have been developed for obtaining sufficient contact pressure at the contacts, and excellent feeling of press operation of the plunger.

For example, one of them is disclosed in Japanese Utility Model Publication No. 4-22500 as a "miniature switch".

The "miniature switch" of Japanese Utility Model Publication No. 4-22500 is constituted by a housing which is configured by a switch base, and a switch cover fitted into the switch base, a plunger which slides upward and downward with respect to the housing, and a spring which is mounted between the housing and the plunger.

Further, as a spring, the above-mentioned "miniature switch" uses a special spring which is configured by a small diameter coil portion, and a conical large diameter coil portion which is formed with a lager diameter than that of the small diameter coil portion, the small diameter coil portion and the large diameter coil portion being disposed in series. In the constitution, the large diameter coil portion is a movable contact, and a fixed contact portion is formed at a point of the housing which is opposite to the large diameter coil portion so as to move closer to and apart from the same.

Japanese Utility Model Publication No. 4-22500 describes the following advantageous effect that, as mentioned above, by providing the large diameter coil portion to the spring, when being compressed, overlapping of the wires each other can be prevented so that a long stroke in the compression direction can be ensured.

However, in the case of the constitution, like the "miniature switch" of Japanese Utility Model Publication No. 4-22500, in which the large diameter coil portion and the small diameter coil portion are disposed in series, when the plunger is pressed, a desired elastic property cannot be obtained with respect to the spring for bias in the return direction.

For details, generally, when an operator presses the plunger of the switch, just after pressing, the operator receives elastic force from the spring as press load from the plunger so that the operator can recognize his/her pressing of the plunger as perception, thereby obtaining feeling of press operation.

However, in the case of the spring which is provided to the "miniature switch" of Japanese Utility Model Publication No. 4-22500, the large diameter coil portion is more easily deformed elastically, in comparison to the small diameter coil portion. Therefore, when being pressed by a slide of the plunger, first, the large diameter coil portion having a lower elastic modulus, in comparison to the small diameter coil portion, is elastically deformed unduly so that the build-up of elastic force by the press becomes slow.

As a result, even when the operator presses the plunger, the operator does not receive a moderate load from the plunger by the press, and the plunger is pressed down. Therefore, there are some problems that it is difficult for the operator, like perceiving the press, and the feeling of press operation is deteriorated.

On the other hand, Japanese Utility Model Laid-Open Publication No. 6-15232 proposes a "push button switch".

The "push button switch" of Japanese Utility Model Laid-Open Publication No. 6-15232 includes a push button which can be pushed downward, a pair of terminals which are brought into a conductive state by contact of a contact spring, and two kinds of springs, i.e., a return spring and a contact spring.

The contact spring is disposed outside (on the upper side of) the push button, and is held under a compressed state by a spring holding portion which is disposed at a lower portion of the push button. The spring holding portion is biased in the press down direction with weak force by the return spring, and from the time point when the spring holding portion is pressed down lower than the pair of terminals, the return spring makes contact with the pair of terminals so as to bring the pair of terminals into a conductive state therebetween.

The above-mentioned "push button switch" of Japanese Utility Model Laid-Open Publication No. 6-15232 is provided with two kinds of springs, i.e., the return spring and the contact spring which are separately disposed, so that the return spring having a moderate elastic property is elastically deformed just after the operator presses the push button. Therefore, it is expected to produce an advantageous effect that the operator can perceive moderate feeling by the press from the push button just after pressing.

However, in the "push button switch" of Japanese Utility Model Laid-Open Publication No. 6-15232, as the push button is pressed, the spring holding portion is pressed downward, and the contact spring becomes to make contact with the pair of terminals from the time point when the spring holding portion is located lower than the pair of terminals. But, even when the push button is further pressed, the contact pressure against the pair of terminals is constant because the length of the contact spring does not change.

Namely, in the "push button switch" of Japanese Utility Model Laid-Open Publication No. 6-15232, once the contact spring has made contact with the pair of terminals, even when the push button is pressed, the contact pressure between the contact spring and the pair of terminals has already reached the limit. Moreover, the contact spring is disposed in a mode in which the contact spring is expanded as the push button for the holding portion is pressed until making contact with the pair of terminals. Therefore, there is a restriction that the force by the elasticity for biasing the spring holding portion in the press down direction is weaker than the force by the return spring. Accordingly, it should be difficult for the constitution to ensure sufficient contact pressure against the pair of terminals.

Accordingly, the "push button switch" of Japanese Utility Model Laid-Open Publication No. 6-15232 has a problem that reliability of the electrical conduction cannot be ensured.

Moreover, in the "push button switch" of Japanese Utility Model Laid-Open Publication No. 6-15232, the feeling of pressing hardly change after the contact spring makes contact with the pair of terminals, and therefore, it is practically impossible to perceive the fact that the contact spring has made contact with the pair of terminals. Accordingly, there is another problem that an operator cannot obtain satisfactory feeling of operation.

SUMMARY OF THE INVENTION

An object of this invention is to provide a switch in which the contact pressure against a pair of terminals of a terminal contact spring is increased so that the reliability of electrical conduction between the pair of terminals can be enhanced, and a feeling of press operation of the plunger can also be enhanced.

In accordance with one aspect of invention switch, the switch includes: a housing; a plunger that slides in a press direction or a return direction with respect to the housing; a return spring that biases the plunger in the return direction and is compressed by a slide of the plunger in the press direction; a plurality of terminals that are brought into a conductive state according to a predetermined state of the plunger; and a terminal contact spring that makes contact with the terminals so as to bring the terminals into a conductive state by the slide of the plunger in the press direction; wherein the terminal contact spring is disposed so as to be compressed according to the slide of the plunger in the press direction under a contact state of making contact with the terminals.

According to another aspect of the switch, under the contact state in which the terminal contact spring makes contact with the terminals, the contact pressure between the terminal contact spring and the terminals can be increased according to the slide of the plunger in the press direction. Accordingly, excellent electrical conductivity can be obtained by ensuring sufficient contact pressure between the terminal contact spring and the terminals.

Moreover, the terminal contact spring is compressed by the contact with the terminals so that, under the contact state of making contact with the terminals, the return spring can be elastically deformed into a compressed state according to the slide of the plunger in the press direction, and also, the terminal contact spring can be elastically deformed into a compressed state.

In the process that an operator presses the plunger, the elastic force of the terminal contact spring, which acts when the terminal contact spring makes contact with the terminals, can be fed back to the operator as feeling which is received by the operator.

Therefore, in the process that the operator presses the plunger, it is possible to make the operator perceive the position where the terminal contact spring and the terminals are made contact with each other, namely, the position where the switch is actuated, so that the operator can obtain satisfactory feeling of press operation.

Further, it is possible for the terminal contact spring, under the contact state of making contact with the terminals, to increase the contact pressure when making contact with the terminals according to the slide of the plunger in the press direction so that the contact pressure between the contact spring and the pair of terminals can be increased according to the press of the plunger. Accordingly, feeling of press operation, which is consistent with the feeling of the operator, and is satisfactory for the operator, can be obtained.

Moreover, as mentioned above, because the return spring and the contact spring are provided, just after the operator presses the plunger, the return spring having moderate elastic property is elastically deformed so that the operator, just after pressing the plunger, receives an initial load based on this elastic deformation from the plunger. Accordingly, the operator can perceive moderate feeling by the press of the plunger just after the press so that the feeling of operation can be enhanced.

As a mode of this invention, a spring compression holding portion, which holds the terminal contact spring under a compressed state, may be formed at the plunger.

According to one aspect of the switch, the terminal contact spring can be made contact with the terminals under the state in which the terminal contact spring is compressed. With this, excellent elastic force of the terminal contact spring under a compressed state can be acted on the terminals just after the terminal contact spring makes contact with the terminals.

Therefore, the contact pressure between the terminal contact spring and the terminals can be increased just after the terminal contact spring makes contact with the terminals, and therefore, even if foreign bodies, such as oxide film, exist on the terminal surface, it is possible to stabilize the electrical conductivity after the contact.

Moreover, for example, the terminal contact spring expands and contracts according to the press of the plunger in the slide direction so that, when making contact with the terminals, the electrical conductivity at the time of contact is not made unstable due to, for example, repeated contacts and departures with short periods, and thereby enabling the electrical conductivity to be stabilized.

Further, the terminal contact spring can be restricted to a predetermined length without being affected by the dimensional tolerance of the spring, and therefore, the press amount of the plunger until the terminal contact spring makes contact with the terminals can be stabilized.

According one aspect of the switch, the terminal contact spring may be configured so as to have increasingly larger diameter from the end portion on the return direction side toward the press direction.

According to another aspect of the switch, the wires forming the terminal contact spring are not overlapped with each other in the slide direction so that the terminal contact spring can be firmly compressed. With this, a longer compression stroke of the spring can be ensured in comparison to a spring which is formed with the same diameter from the end portion on the return direction side toward the press direction.

Accordingly, the terminal contact spring can be sufficiently compressed, and therefore, a sufficient contact pressure between the terminal contact spring and the terminals can be obtained, and the terminal contact spring can be miniaturized so that the switch can be miniaturized.

Particularly, in the case of the terminal contact spring which is configured so as to be gradually enlarged in its diameter from the end portion on the return direction side toward the press direction, at the plunger which is provided with the spring compression holding portion, the terminal contact spring can be surely and easily held by the spring compression holding portion.

According to one aspect of the switch, an end portion on a return direction side of the terminal contact spring may be provided with an engagement portion that makes the terminal contact spring engage with the plunger in a circumferential direction, and the plunger may be provided with an engagement allowable portion that engages with the engagement portion, and an end portion on the press direction of a wire, which constitutes the terminal contact spring, may be disposed at a position so as not to make contact with the terminals in a circumferential direction of the terminal contact spring.

According to the above-mentioned constitution, by making the engagement allowable portion engage with the engagement portion, the terminal contact spring can be easily attached to the plunger.

Under a state in which the engagement allowable portion engages with the engagement portion, it is preferred that the end portion on the press direction side of the wire, which constitutes the terminal contact spring, is disposed at a position so as not to make contact with the terminals in the circumferential direction of the terminal contact spring.

With this, the end portion on the press direction side of the wire, which constitutes the terminal contact spring, does not make contact with the terminals, and therefore, the terminal contact spring can be stably made contact with the terminals so that excellent electrical conductivity can be ensured.

When attaching the terminal contact spring to the plunger, in the circumferential direction of the terminal contact spring, the terminal contact spring can be easily attached without paying attention so as not to dispose the end portion on the press direction side of the wire, which constitutes the terminal contact spring, at a position where no contact is made with the terminals.

Moreover, the engagement portion may be formed with an engagement side which protrudes in the diametric inner direction or the diametric outer direction from the end portion on the return direction side in the terminal contact spring. The engagement portion can be made to firmly engage with the edge portion of the engagement allowable portion by making the engagement side engage with the engagement allowable portion.

According to another aspect of the switch, the engagement portion in the terminal contact spring can be fixed under pressure to the plunger by the end portion on the return direction side of the return spring.

By the above-mentioned constitution, the terminal contact spring can be firmly attached to the plunger.

Further, the above-mentioned firm attachment of the terminal contact spring to the plunger can be realized by the attachment of the terminal contact spring to the plunger, and therefore, there is no need to additionally dispose a constitution for fixing the engagement portion under pressure to the plunger so that a simple constitution can be realized by an assembling process with fewer steps.

According to this invention, by increasing the contact pressure of the terminal contact spring against the pair of terminals, there can be provided a switch in which the reliability of the electrical conductivity between the pair of terminals can be enhanced, and also the feeling of press operation of the plunger can be enhanced.

BRIEF DESCRIPTION OF THE DRAWINGS

FIGS. 4A1 to 4B2 are operational explanatory diagrams of a press process of the switch using a sectional view of the switch according to the first embodiment;

FIGS. 8A1 to 8B2 are operational explanatory diagrams of a press process of the switch using a sectional view of the switch according to the second embodiment;

DETAILED DESCRIPTION

Figure 1A:
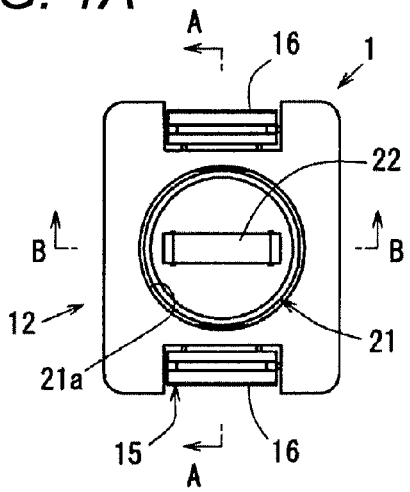
FIGS. 1A to 1C are constitutional explanatory diagrams of a switch according to a first embodiment.

One embodiment of this invention will be described with reference to the drawings hereunder.

As illustrated in FIG. 1A to FIG. 3B, a switch 1 according to a first embodiment is constituted by a housing 11, a plunger 21 which slides in a press direction D1 or a return direction D2 with respect to the housing 11, a spring 30, and a pair of terminals 41 which are brought into a conductive state according to a press of the plunger 21.

Figure 1B:
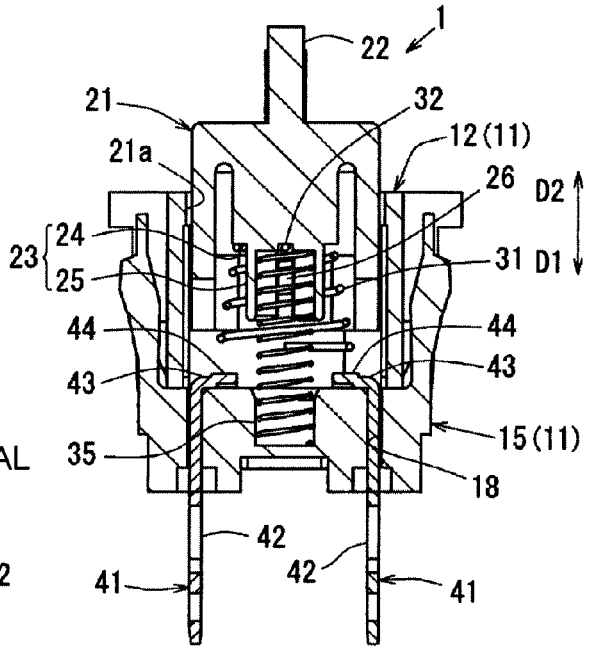
Figure 1C:
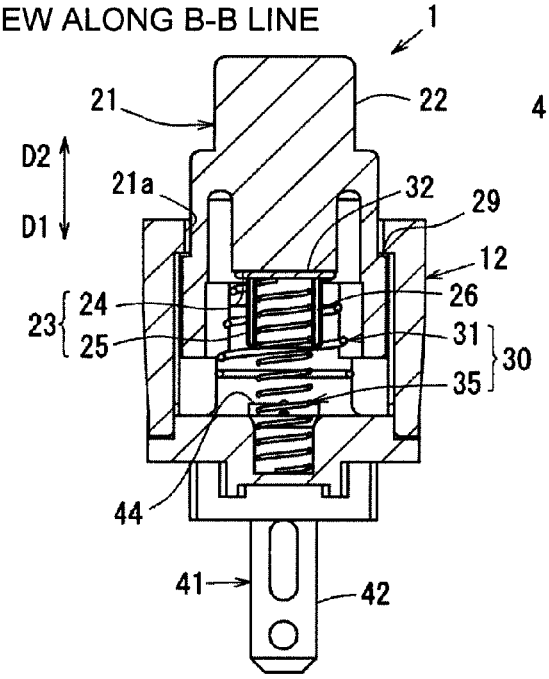
Figure 2:
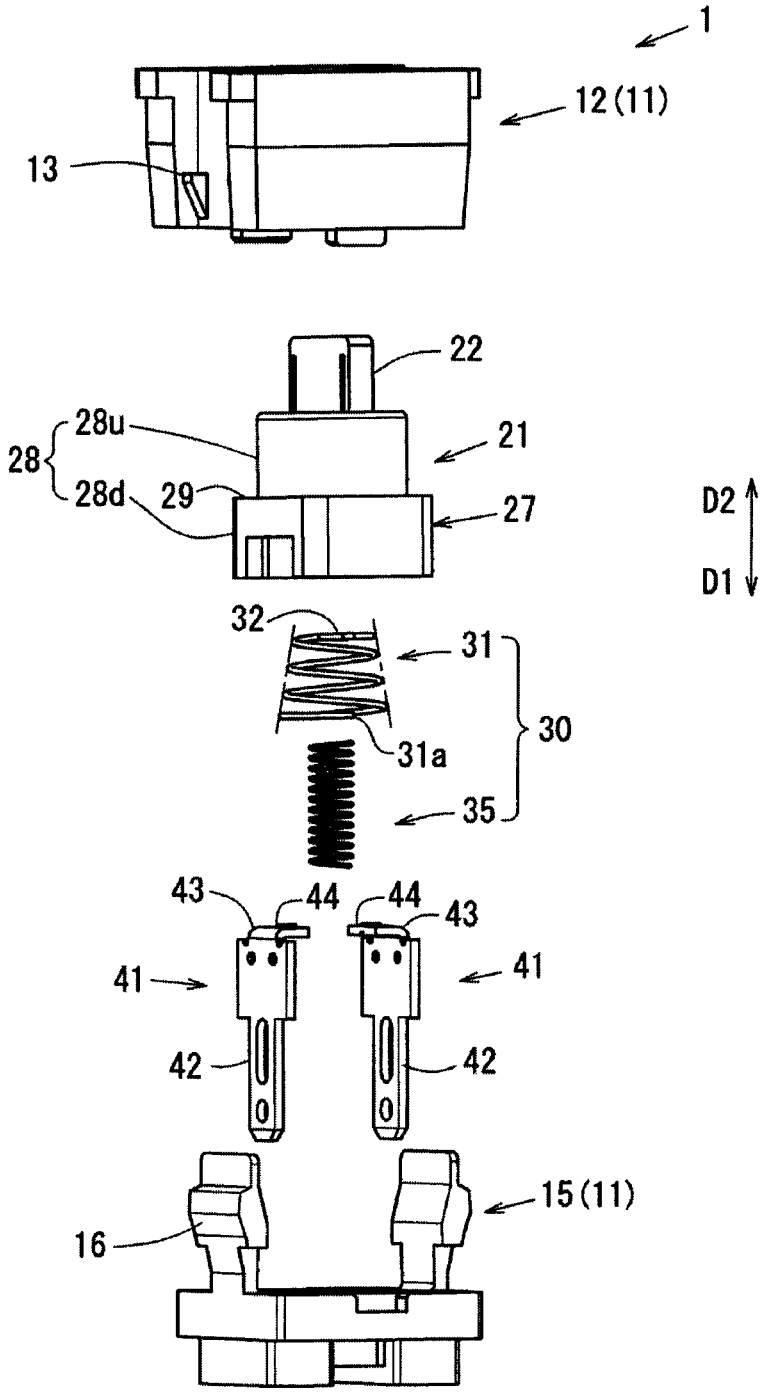
FIG. 2 is an exploded perspective view of the switch according to the first embodiment.
Figure 3A:
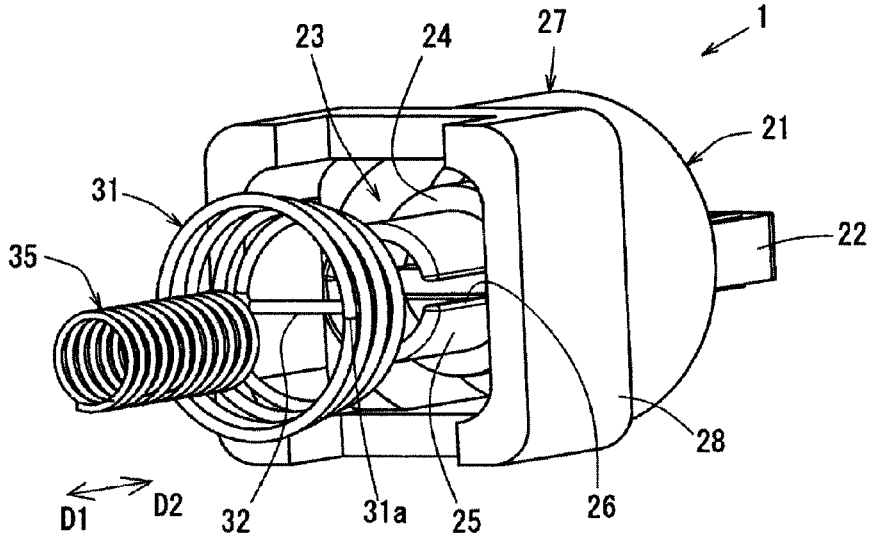
FIGS. 3A and 3B are perspective views of the switch according to the first embodiment obliquely seen from the back.
Figure 3B:
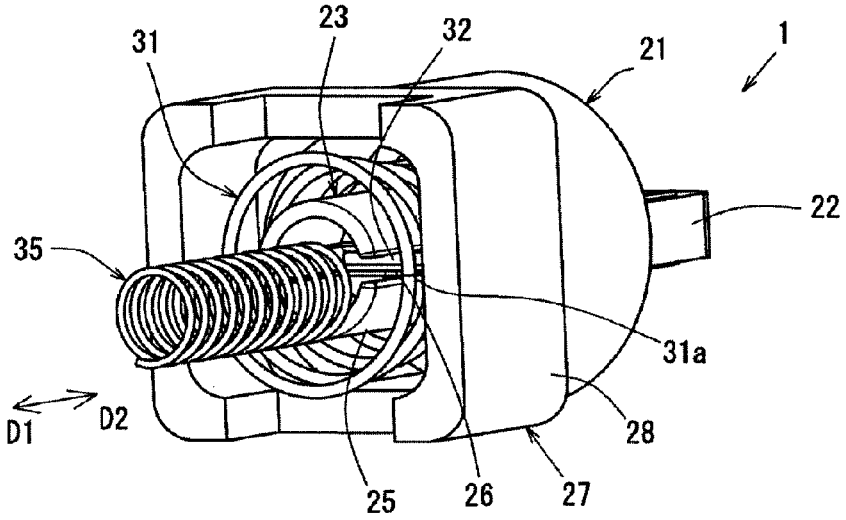

Note that, FIG. 1A is a plan view of the switch 1, FIG. 1B is an enlarged cross sectional view along the A-A line in FIG. 1A, and FIG. 1C is an enlarged cross sectional view along the B-B line in FIG. 1A. FIG. 2 is an exploded perspective view of the switch 1. FIG. 3A is a perspective view, which is seen from the press direction D1 side of the switch 1, of a state in which a terminal contact spring 31 is not mounted to the plunger 21 yet. FIG. 3B is a perspective view, which is seen from the press direction D1 side of the switch 1, of a state in which a return spring 35 is not mounted to the plunger 21 yet.

Moreover, for convenience, as illustrated in FIGS. 1B and 1C, the following descriptions will be made based on a state in which the switch 1 is disposed such that the press direction D1 is the downward direction of the switch 1, and the return direction D2 is the upward direction of the switch 1.

As illustrated in FIG. 2, the terminal 41 is constituted by an elongated plate shaped terminal main body 42, and a base housing engagement piece 43 which is formed by bending the base end portion of the terminal main body 42 at a substantially right angle. A spring contact surface 44 is formed on the upper surface of the base housing engagement piece 43.

The housing 11 is constituted by a main body housing 12 disposed on the upper side, and a base housing 15 disposed on the lower side. In the main body housing 12, a plunger insertion hole 21*a*, into which the plunger 21 can be inserted, is formed on the upper portion thereof, and a base housing engagement protruding piece 13, which can engage with the base housing 15, is formed.

On the other hand, a pair of terminal insertion portions 18 are formed at the base housing 15 with a predetermined space therebetween such that the terminal main bodies 42 can be vertically inserted therein under a state in which the terminal main bodies 42 protrude downward therefrom, and base housing engagement pieces 43 are mounted to the terminal insertion portions 18 so as to enable the base housing engagement pieces 43 to be engaged with the edge portions thereof. Further, housing hooks 16 are formed at the base housing 15 so as to protrude upward such that the housing hooks 16 can be engaged with the base housing engagement pieces 43 (refer to FIG. 1B).

The plunger 21 is constituted by a plunger base portion 27, a press portion 22 which protrudes upward such that an operator can press the press portion 22 with respect to the plunger base portion 27. The plunger base portion 27 is provided with a slide portion 28 which is formed so as to be slidable with respect to the inner wall surface of the housing 11, and a spring mounting portion 23.

The slide portion 28 is formed on the outer circumferential surface of the plunger base portion 27 by an upper slide portion 28*u*, and a lower slide portion 28*d* whose diameter is larger than that of the upper slide portion 28*u*. Between the lower slide portion 28*d* and the upper slide portion 28*u*, an engagement stepped portion 29 is formed so as to be engaged with the circumferential portion of the plunger insertion hole 21*a* of the housing 11 so that the plunger 21 cannot slip out of the housing 11.

As illustrated in FIGS. 3A and 3B, the spring mounting portion 23 are constituted by a spring abutment portion 24 which is formed at the lower portion of the plunger base portion 27, and a spring tubular fitting portion 25.

The spring abutment portion 24 is formed in a planar state at the lower portion of the plunger base portion 27 such that an end portion on the return direction D2 side of the terminal contact spring 31 described below can be abutted against the spring abutment portion 24.

The spring tubular fitting portion 25 is formed so as to protrude in a tubular shape downward from the spring abutment portion 24 such that the portion on the return direction D2 side of the return spring 35 described below can be fitted into the spring tubular fitting portion 25.

Moreover, engagement grooves 26 are formed at the spring tubular fitting portion 25 so as to have a shape which is formed by cutting out predetermined portions of the spring tubular fitting portion 25, which are opposite to each other over the center in the circumferential direction, from the distal end in the protruding direction (press direction D1) to the proximal end so that an engagement side 32 of the terminal contact spring 31 described below can be engaged by being fitted therein.

The spring 30 is provided with two kinds of coil springs 30 including the return spring 35 which biases the plunger 21 in the return direction D2 and is compressed by a slide of the plunger 21 in the press direction D1, and the terminal contact spring 31 which makes contact with the terminals 41 by a slide of the plunger 21 in the press direction D1, thereby bringing the terminals 41 into a conductive state therebetween.

The return spring 35 is formed so as to have a spring length which is longer than that of the terminal contact spring 31, and is disposed in a compressed state in an initial state in which the plunger 21 is not pressed.

As illustrated in FIG. 2, the terminal contact spring 31 is formed so as to have a coil diameter on the end portion side in the return direction D2 which is larger than the outer diameter of the return spring 35, and have a conical shape which is gradually enlarged in its diameter from the end portion on the return direction D2 side toward the press direction D1. Note that, the end portion side in the press direction D1 of the terminal contact spring 31 is formed to have a diameter which is opposite in the upward and downward directions to the spring contact surface 44 of the terminals 41 which are inserted into the terminal insertion portions 18.

Further, the terminal contact spring 31 forms the engagement side 32, which protrudes in a diametrically inner direction, on the end portion side on the return direction D2 side (refer to FIG. 3A). Note that, the engagement side 32 is a bent portion which is formed by linearly bending the end portion side on the return direction D2 side in a radially inner direction.

The above-mentioned switch 1 is integrally assembled as described below.

The plunger 21 is inserted into the plunger insertion hole 21*a* of the main body housing 12 such that the engagement stepped portion 29 of the plunger 21 is brought into a state of being engaged with the circumferential portion of the plunger insertion hole 21*a* of the housing 11, and also the press portion 22 of the plunger 21 is brought into a state in which the press portion 22 protrudes upward with respect to the main body housing 12.

The plunger 21 is inserted into the plunger insertion hole 21*a* of the main body housing 12 under a state in which the press portion 22 of the plunger 21 protrudes upward with respect to the main body housing 12 in order to enable the engagement stepped portion 29 of the plunger 21 to be engaged with the circumferential portion of the plunger insertion hole 21*a* of the housing 11 so that the plunger 21 cannot slip out of the housing 11 in the return direction D2.

Then, the engagement side 32 of the terminal contact spring 31 is fitted into the engagement grooves 26 so as to be engaged in the circumferential direction with the edge portions of the engagement grooves 26, and also the end portion on the return direction D2 side of the terminal contact spring 31 is abutted against the spring abutment portion 24.

Further, by firmly fitting the return spring 35 therein to the base portion of the spring tubular fitting portion 25, the engagement side 32 of the terminal contact spring 31 can be fixed under pressure to the plunger 21 by means of the end portion on the return direction D2 side in the length direction of the terminal contact spring 31.

On the other hand, the terminal main bodies 42 are respectively inserted into the pair of terminal insertion portions 18 of the base housing 15, and the base housing engagement pieces 43 are engaged with the edge portions of the terminal insertion portions 18 so that the terminals 41 are mounted.

Then, the main body housing 12 and the base housing 15 are disposed so as to be opposite to each other in the upward and downward directions, and also the base housing engagement protruding piece 13 and the housing hook 16 are engaged with each other so that the assembling of the switch 1 is completed.

At this time, as illustrated in FIGS. 1B and 1C, the return spring 35 is contained under a state of being compressed so as to bias the plunger 21 in the return direction D2.

Next, functions and advantageous effects, which are performed by the switch 1 when an operator presses the press portion 22 so as to actuate the switch 1 (ON), will be described with reference to FIGS. 1B and 1C, FIGS. 4A1, 4A2, 4B1, and 4B2, and FIGS. 5A and 5B, and a conventional example will be described with reference to FIGS. 12A and 12B.

Note that, both of FIGS. 1B and 1C illustrate the state in which the press portion 22 is not pressed (the state in which the plunger 21 is located at the free position (which is called "FP" hereunder)). Both of FIGS. 4A1 and 4B1 illustrate the state just after the terminal contact spring 31 and the spring contact surfaces 44 of the terminals 41 have made contact with each other (the state in which the plunger 21 is located at the operating position (which is called "OP" hereunder)). Specifically, FIG. 4A1 corresponds to FIG. 1B, and FIG. 4B1 corresponds to FIG. 1C. Both of FIGS. 4A2 and 4B2 illustrate the state in which the plunger 21 is pressed downward to the operational limit position (the state in which the plunger 21 is located at the total travel position (which is called "TTP" hereunder)). Specifically, FIG. 4A2 corresponds to FIG. 1B, and FIG. 4B2 corresponds to FIG. 1C.

Figure 5A:
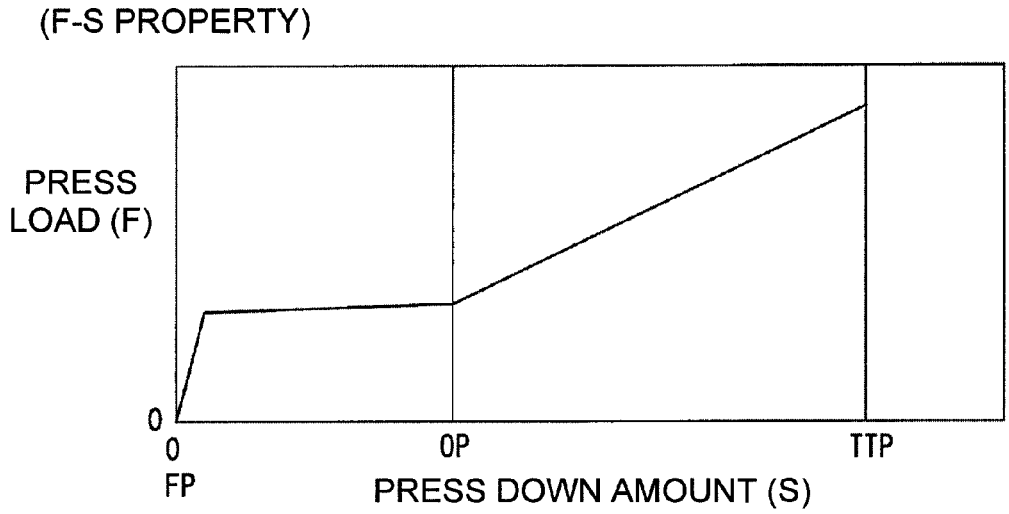
FIGS. 5A and 5B are graphs illustrating properties of the switch according to the first embodiment.
Figure 5B:
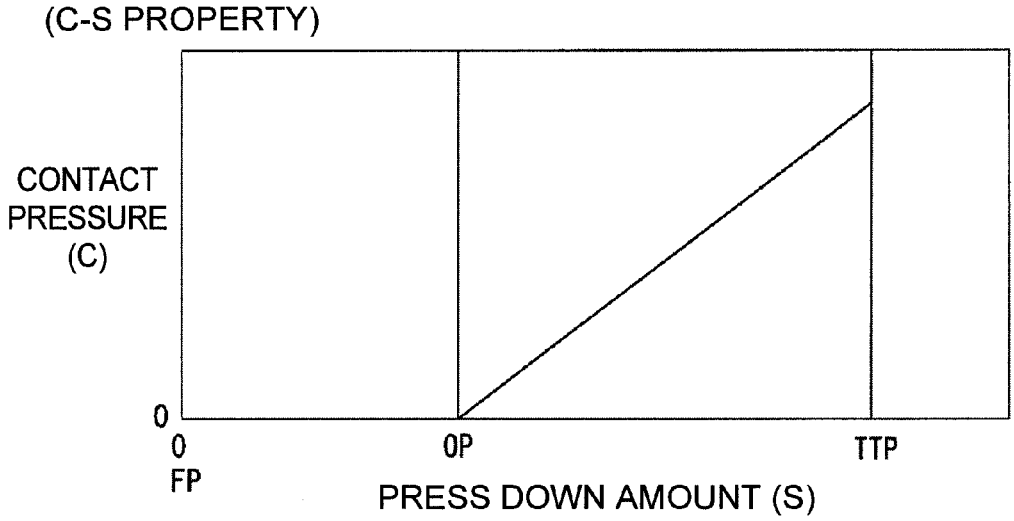
Figure 12A:
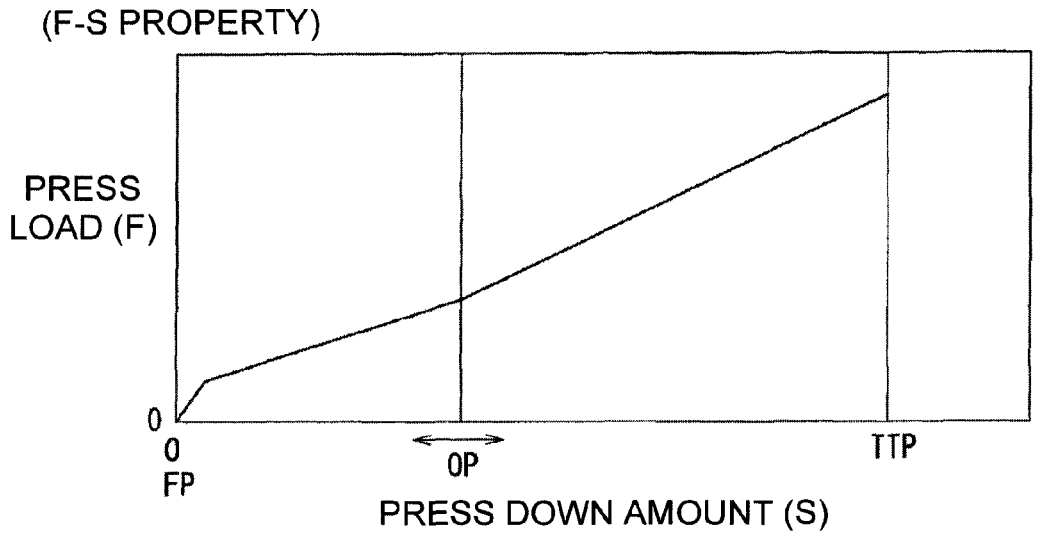
FIGS. 12A and 12B are graphs illustrating properties of a conventional switch.
Figure 12B:
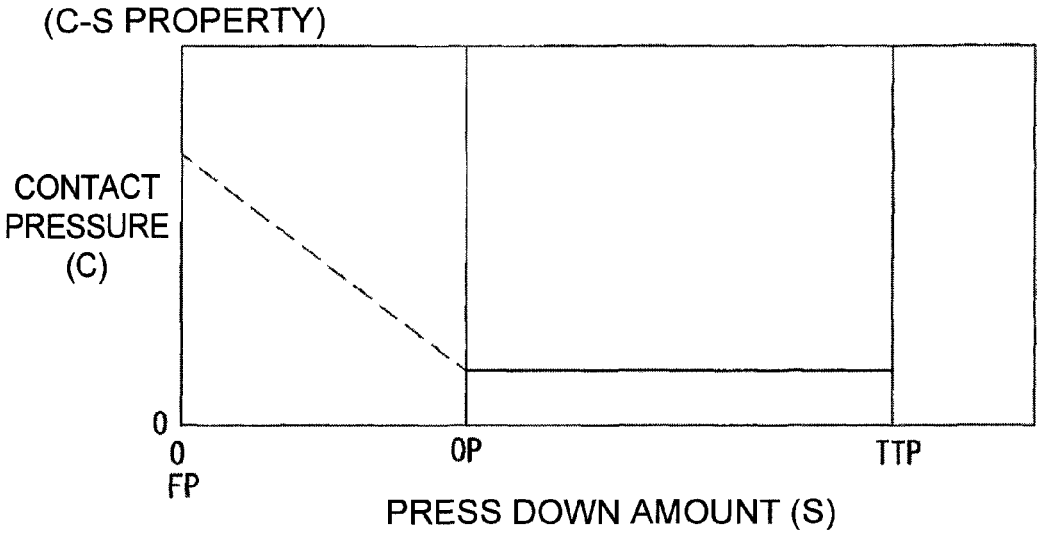

Moreover, both of FIG. 5A and FIG. 12A are graphs which illustrate F-S properties, and both of FIG. 5B and FIG. 12B are graphs which illustrate C-S properties.

Here, the F-S property is a property of the switch which is based on a relationship between a press load (F) pressing the press portion and a press down amount (S) of the press portion. The C-S property is a property of the switch which is based on a relationship between a contact pressure (C) when the terminal contact spring makes contact with the terminals and the press down amount (S) of the press portion.

For details, FIG. 5A is a graph illustrating the F-S property of the switch 1 according to the first embodiment which is based on the relationship between the press load (F) pressing the press portion 22 and the press down amount (S) of the press portion 22.

FIG. 5B is a graph illustrating the C-S property of the switch 1 according to the first embodiment which is based on the relationship between the contact pressure (C) when the terminal contact spring 31 makes contact with the terminals 41 and the press down amount (S) of the press portion 22 of the switch 1.

FIG. 12A is a graph illustrating the F-S property of the switch as a conventional example which is described in Japanese Utility Model Publication No. 4-22500. FIG. 12B is a graph illustrating the C-S property of the switch as a conventional example which is described in Japanese Utility Model Laid-Open Publication No. 6-15232.

First, as illustrated in FIGS. 1B and 1C, an explanation will be made focusing on functions of the switch 1 which are performed when an operator starts pressing the press portion 22.

According to the above-mentioned constitution, even if the plunger 21 is under the state of FP, the return spring 35 is compressed so as to bias the plunger 21 in the return direction D2, and therefore, when an operator presses the plunger 21 under the FP state of the plunger 21, the operator receives an initial load which is based on elastic deformation of the return spring 35 from the plunger 21.

Accordingly, just after pressing, the operator can perceive a moderate feeling by the press so that the feeling of press operation of the operator can be enhanced.

For details, there is a conventional switch provided with a special spring having a small diameter portion and a conical large diameter portion which are disposed in series, like the "miniature switch" of Japanese Utility Model Publication No. 4-22500. In the case of such a conventional switch, because the large diameter portion has a lager diameter than that of the small diameter portion, in comparison to the small diameter portion, the large diameter portion is less able to produce the press load (repulsive force) based on the elastic force by the compression.

Thus, as illustrated in FIG. 12A, a sufficient initial load by the press of the plunger cannot be applied, as apparent from the fact that the press load of the plunger just after pressing the plunger which is in the FP state is relatively small. Then, even when the operator presses the press portion, the operator cannot perceive the feeling (press feeling) from the plunger which is being pressed. Accordingly, there was a problem that the operator cannot obtain satisfactory feeling of press operation.

On the other hand, in the switch 1 of the first embodiment, as mentioned above, the return spring 35 is formed with the same diameter over the full length so as to exhibit a linear elastic property, and is disposed under the state of being preliminarily compressed so as to bias the plunger 21 in the return direction D2 in the state that the plunger 21 is located at FP. Accordingly, an excellent elastic force can be produced at the moment when the press portion 22 is pressed.

Accordingly, as illustrated in FIG. 5A, when the operator presses the press portion 22, the operator receives from the plunger 21 the press load (biasing force) based on the elastic force of the return spring 35 which is originally compressed. Therefore, the operator can firmly perceive the press feeling so that the feeling of press operation for the operator can be enhanced (refer to the value of press load of the plunger 21 in FIG. 5A just after the plunger 21 at the FP position is pressed).

Next, functions and advantageous effects, which are performed by the switch 1 according to the slide of the plunger 21 in the press direction D1 from just before the plunger 21 reaches the OP until reaching the TTP, will be described.

First, in the case of the "push button switch" of Japanese Utility Model Laid-Open Publication No. 6-15232, according to the press of the push button, the spring holding portion is pressed down, and the contact spring is extended. According to this, as illustrated in FIG. 12B, the biasing force of the contact spring gradually decreases.

Then, in the case of the "push button switch" of Japanese Utility Model Laid-Open Publication No. 6-15232, under the state in which the contact spring makes contact with the terminals, even when the push button is further pressed, the length of the contact spring does not change. Accordingly, after the contact spring makes contact with the terminals, as illustrated in FIG. 12B, the contact pressure of the contact spring against the pair of terminals reaches the limit so as to be constant.

Then, for the "push button switch" of Japanese Utility Model Laid-Open Publication No. 6-15232, there was a problem that, under the state in which the contact spring makes contact with the terminals, even when the push button is pressed, sufficient contact pressure according to the press down stroke cannot be obtained so that the reliability of the electrical conductivity cannot be ensured.

Further, under the state in which the contact spring makes contact with the terminals, even when the push button is pressed, the elastic force of the contact spring reaches the limit so as to be constant, and this is not consistent with the feeling for operator when pressing the push button that the contact pressure between the contact spring and the pair of terminals can be enhanced according to the press amount (press stroke) for pressing the push button. Therefore, there is a problem that the satisfactory feeling of press operation cannot be obtained.

Moreover, in the case of the "miniature switch" of Japanese Utility Model Publication No. 4-22500, as mentioned above, this switch is provided with the spring including the large diameter portion and the small diameter portion which are formed in series and have the different elastic properties. And, in the case of such a spring, the large diameter portion is less able to perform sufficient elastic property in comparison to the small diameter portion, and therefore, there is a tendency that the elastic property with respect to the load becomes unclear.

Then, as illustrated in FIG. 12A, the press load hardly changes before and after the movable contact makes contact with the fixed contact, namely, before and after the plunger reaches the OP. Thus, there is a problem that it is almost impossible to perceive the contact of the contact spring with the pair of terminals (refer to the value of press load of the plunger under the state in which the plunger is in the state of OP in FIG. 12A).

On the other hand, in the switch 1 of the first embodiment, even from the state in which the plunger 21 is at the OP as illustrated in FIGS. 4A1 and 4B1 to the state in which the plunger 21 reaches the TTP as illustrated in FIGS. 4A2 and 4B2, namely, under the contact state in which the terminal contact spring 31 makes contact with the terminals 41, the terminal contact spring 31 is compressed according to the slide of the plunger 21 in the press direction D1 as illustrated in FIGS. 4A2 and 4B2.

Accordingly, as illustrated in FIG. 5B, from the moment when the plunger 21 reaches the OP, by the elastic force of the terminal contact spring 31 based on the compression, the contact pressure between the terminal contact spring 31 and the terminals 41 can be enhanced according to the slide of the plunger 21 in the press direction D1.

Therefore, a sufficient contact pressure between the terminal contact spring 31 and the terminals 41 can be ensured so that excellent electrical conductivity can be obtained.

Further, even in the process in which the operator presses the plunger 21, under the contact state in which the terminal contact spring 31 makes contact with the terminals 41, as mentioned above, the terminal contact spring 31 is compressed according to the slide of the plunger 21 in the press direction D1. Accordingly, when the plunger 21 in the OP state is further pressed, as illustrated in FIG. 5A, the biasing force of the compressed terminal contact spring 31 gradually increases, and the biasing force of the terminal contact spring 31 can be fed back to the operator as the press load which is received by the operator.

Therefore, in the process in which the operator presses the plunger 21, an advantageous effect that it is easy to make the operator perceive the position where the terminal contact spring 31 and the terminals 41 are made contact with each other, namely, the position where the switch 1 is actuated.

Furthermore, under the contact state in which the terminal contact spring 31 makes contact with the terminals 41, the contact pressure when making contact with the terminals 41 can be enhanced according to the slide of the plunger 21 in the press direction D1 (refer to FIG. 5A), and therefore, the contact pressure between the contact spring 31 and the terminals 41 is enhanced according to the slide of the plunger 21 in the press direction D1. This is consistent with the feeling of operator and the operation result so that a feeling of press operation, with which the operator is satisfied, can be obtained.

Moreover, as mentioned above, the "miniature switch" of Japanese Utility Model Publication No. 4-22500 is provided with special spring having the small diameter portion and the conical large diameter portion which are disposed in series, and therefore, there is a fear that stress is concentrated on the connecting portion between the small diameter portion and the large diameter portion. Accordingly, there is a difficult point that a desired durability cannot be ensured.

On the other hand, the switch 1 of the first embodiment has a constitution which is provided with the cylindrical return spring 35 and the conical terminal contact spring 31, separately, and therefore, such a shape can be obtained that there is no portion whose diameter drastically changes in the respective length directions of the return spring 35 and the terminal contact spring 31.

Accordingly in the switch 1 of the first embodiment, no stress is concentrated on a part in the length direction, and therefore, the durability can be enhanced in comparison to the above-mentioned "miniature switch" of Japanese Utility Model Publication No. 4-22500.

Further, the switch 1 of the first embodiment can perform such functions and advantageous effects as described below.

In the switch 1 of the first embodiment, the terminal contact spring 31 is formed so as to have a diameter which is gradually enlarged in the press direction D1 from the end portion on the return direction D2 side.

According to the above-mentioned constitution, the terminal contact spring 31 can be compressed without making the wires forming the terminal contact spring 31 overlapped with each other in the slide direction, and therefore, a larger amount of compression stroke can be ensured in comparison to the spring which is formed so as to have the same diameter from the end portion on the return direction D2 side along the press direction D1.

Therefore, the terminal contact spring 31 can be sufficiently compressed so that a sufficient contact pressure between the terminal contact spring 31 and the terminals 41 can be obtained, and the switch 1 can be further miniaturized as the terminal contact spring 31 can be miniaturized.

In the switch 1 of the first embodiment, at the end portion on the return direction D2 side of the terminal contact spring 31, the engagement side 32 is formed so as to make the terminal contact spring 31 engaged with the plunger 21 in the circumferential direction, and the engagement grooves 26, with which the engagement side 32 is engaged, are formed at the plunger 21. With this, the engagement side 32 can be engaged with the edge portions of the engagement grooves 26 by only fitting the engagement side 32 into the engagement grooves 26, and therefore, the terminal contact spring 31 can be easily attached to the plunger 21.

Further, in the switch 1 of the first embodiment, under the state in which the engagement side 32 is fitted into the engagement grooves 26 so as to be engaged therewith, an end portion 31*a* (refer to FIG. 3A) on the press direction D1 side of the wire, which constitutes the terminal contact spring 31, is located at the position in the circumferential direction of the terminal contact spring 31 where the end portion 31*a* does not make contact with the spring contact surfaces 44 of the terminals 41.

Accordingly, under the state in which the engagement grooves 26 are engaged with the engagement side 32, the end portion of the wire on the press direction D1 side, which constitutes the terminal contact spring 31, can be disposed at a position in the circumferential direction of the terminal contact spring 31 where the end portion does not make contact with the terminal 41.

Accordingly the terminal contact spring 31 can be made contact with the terminals 41 at a coil portion other than the above-mentioned end portion 31*a*, and therefore, the terminal contact spring 31 can be made in contact with the terminals 41 stably so that excellent electrical conductivity can be ensured.

Further, the terminal contact spring 31 can be easily attached to the plunger 21 without paying attention so as not to dispose the end portion on the press direction D1 side of the wire, which constitutes the terminal contact spring 31, at a position in the circumferential direction of the terminal contact spring 31 where no contact is made with the terminals 41.

Moreover, as mentioned above, under the state in which the engagement side 32 is fitted into the engagement grooves 26 so as to be engaged therewith, further, by fitting the return direction D2 side portion of the return spring 35 into the spring tubular fitting portion 25, the engagement portion of the terminal contact spring 31 can be fixed under pressure to the plunger 21 by the end portion of the return spring 35 on the return direction D2 side (refer to FIG. 1B).

Like this, by attaching the terminal contact spring 31 to the plunger 21, the terminal contact spring 31 can be firmly attached to the plunger 21.

Furthermore, the above-mentioned firm attachment of the terminal contact spring 31 to the plunger 21 can be realized by attaching the return spring 35 to the plunger 21, and therefore, no separate constitution for fixing the engagement portion to the plunger 21 under pressure is required so that a simple constitution can be made, and its assembling can be realized with fewer steps.

Next, a switch 1A of a second embodiment will be described.

However, among the constitutional elements of the switch 1A described below, the constitutional elements similar to those of the above-mentioned switch 1 according to the first embodiment will be denoted with the same reference signs, and their explanations will be omitted.

As illustrated in FIGS. 6A, 6B, and 6C, and FIG. 7, in the switch 1A of the second embodiment, spring compression holding portions 60, which hold the terminal contact spring 31 under a compressed state, are formed at the plunger 21.

Figure 6A:
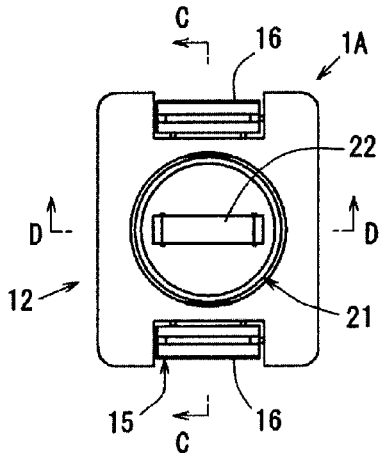
FIGS. 6A to 6C are constitutional explanatory diagrams of a switch according to a second embodiment.
Figure 6B:
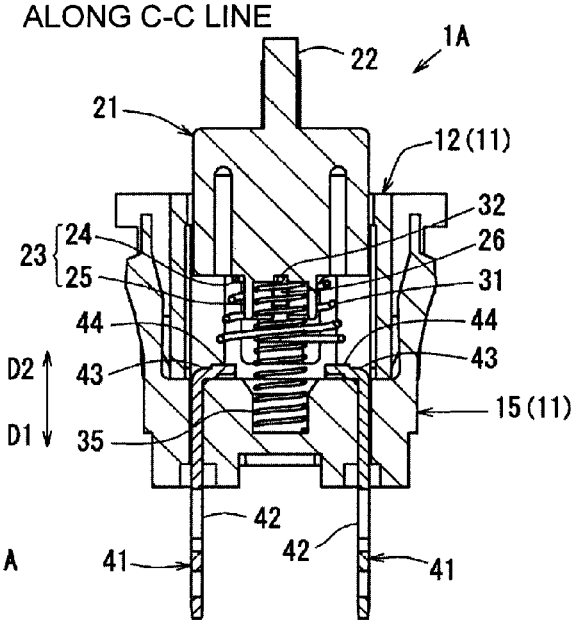
Figure 6C:
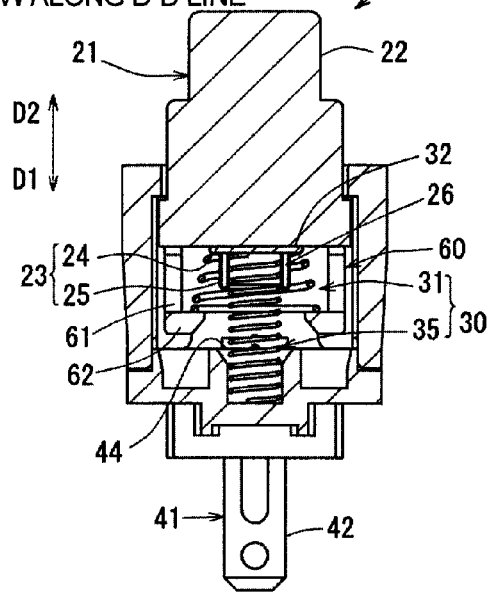
Figure 7:
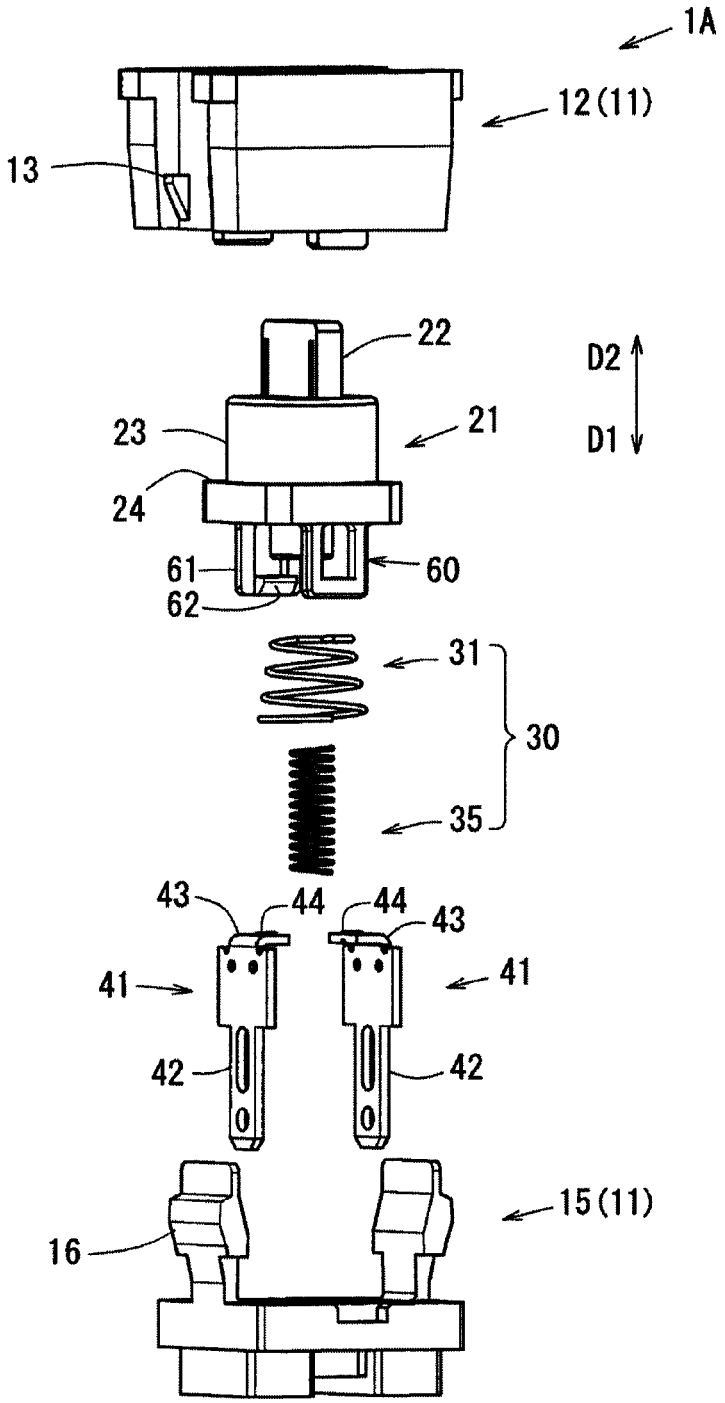
FIG. 7 is an exploded perspective view of the switch according to the second embodiment.

Note that, FIG. 6A is a plan view of the switch 1A, FIG. 6B is an enlarged cross sectional view along the C-C line of FIG. 6A, and FIG. 6C is an enlarged cross sectional view along the D-D line of FIG. 6A. FIG. 7 is an exploded perspective view of the switch 1A.

As illustrated in FIGS. 6A, 6B, and 6C, and FIG. 7, a pair of spring compression holding portions 60 are formed so as to be opposite to each other at the lower portion of the plunger 21 outside the spring mounting portion 23. The spring compression holding portion 60 is formed with an arm portion 61 and a spring engagement claw portion 62.

The arm portions 61 are formed so as to protrude downward. The engagement claw portions 62 are formed at the leading end portions of the arm portions 61 so as to protrude in a way that they are opposite to each other so that the terminal contact spring 31 can be engaged therewith.

According to the above-mentioned constitution, the spring compression holding portion 60 holds the terminal contact spring 31 under the compression state between the lower surface of the spring abutment portion 24 and the upper surface of the spring engagement claw portion 62.

Next, functions and advantageous effects performed by the switch 1A of the second embodiment will be described with reference to FIGS. 8A1, 8A2, 8B1, and 8B2, and FIGS. 9A and 9B.

Figure 9A:
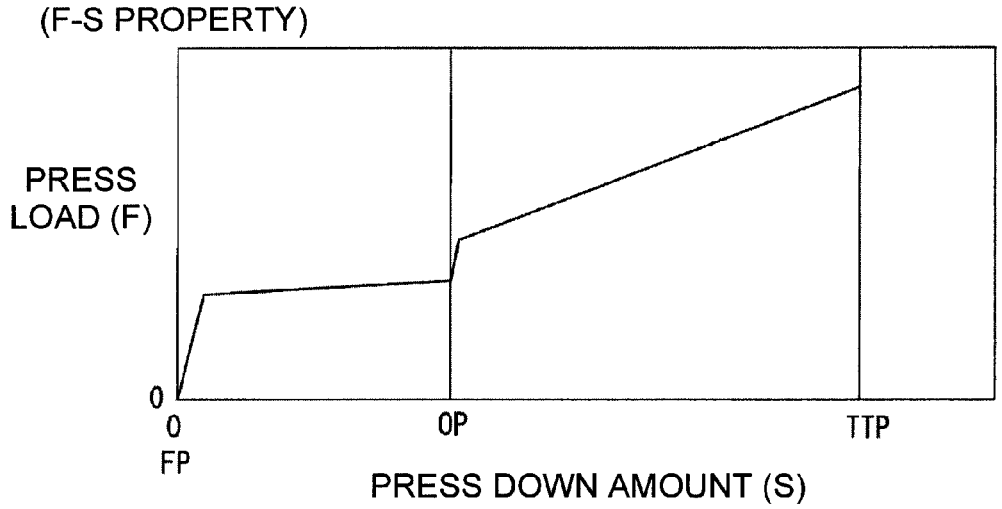
FIGS. 9A and 9B are graphs illustrating properties of the switch according to the second embodiment.

Note that, FIGS. 8A1, 8A2, 8B1, and 8B2 are function explaining diagrams illustrating states in which the plunger 21 of the switch 1A according to the second embodiment is pressed, corresponding to FIGS. 4A1, 4A2, 4B1, and 4B2. FIG. 9A is a graph illustrating the F-S property of the switch 1A according to the second embodiment, and FIG. 9B is a graph illustrating the C-S property of the switch 1A according to the second embodiment.

The switch 1A of the second embodiment holds the terminal contact spring 31 by the spring compression holding portion 60, and therefore, as illustrated in FIGS. 6B and 6C, under the state in which the plunger 21 is at the FP, namely, under the state before the terminal contact spring 31 makes contact with the terminals 41, the terminal contact spring 31 can be made to the compressed state.

With this, as illustrated in FIGS. 8A1 and 8B1, by the slide in the press direction D1 of the plunger 21, under the state in which the terminal contact spring 31 is compressed, the terminal contact spring 31 can be made contact with the terminals 41, and therefore, from the moment when the plunger 21 reaches the OP, the biasing force of the terminal contact spring 31, which is under the compressed state, can be applied to the terminals 41.

Figure 9B:
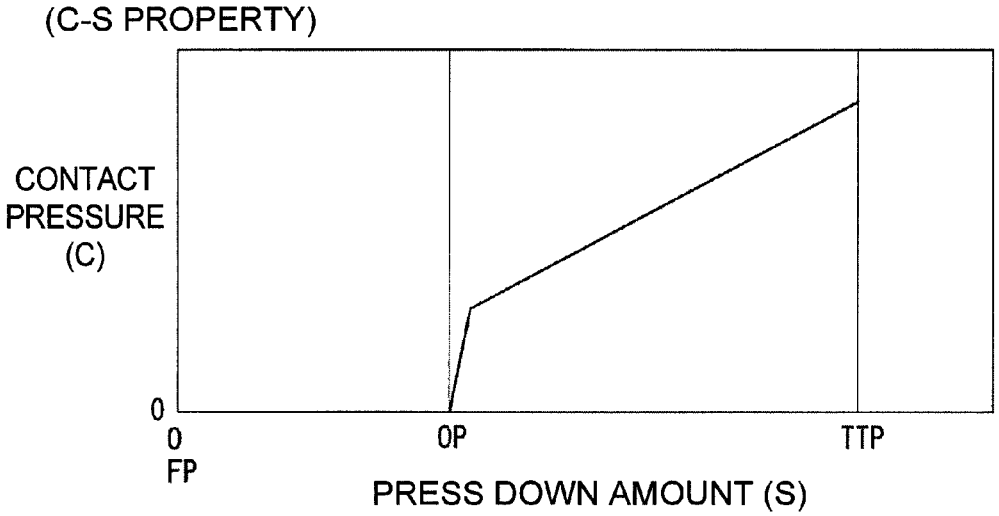

Therefore, as illustrated in FIG. 9B, from just after the terminal contact spring 31 makes contact with the terminals 41, the contact pressure between the terminal contact spring 31 and the terminals 41 can be immediately enhanced, and the electrical conductivity after the contact can be stabilized, even if foreign bodies, such as oxide film, exist on the terminals 41 and so on.

Further, for example, when external force, such as a vibration or an impact, is applied to the switch 1A, the terminal contact spring 31 does not expand and contract unexpectedly according to the press of the plunger 21 in the slide direction. Therefore, specifically in the state in which the plunger 21 is located adjacent to the OP, such an event does not occur that the electrical conductivity when making contact with becomes unstable due to the state that the terminal contact spring 31 repeatedly makes contact with the terminals 41, and separates from the same. With this, the electrical conductivity when making contact with can be stabilized.

Furthermore, the terminal contact spring 31 can be restricted to a predetermined length between the lower surface of the base portion of the plunger 21 and the upper surface of the spring engagement claw portion 62, and therefore, the terminal contact spring 31 can be made contact with the terminals 41 stably without being affected by the dimension error of the terminal contact spring 31.

Moreover, in the case of a conventional spring which is constituted by a large diameter portion and a small diameter portion which are integrally formed in series, such as the "miniature switch" of Japanese Utility Model Publication No. 4-22500, the dimension error due to processing becomes large, and therefore, such a problem occurs that the OP varies between rots (refer to the arrow adjacent to the OP in FIG. 12A).

On the other hand, in the switch 1A of the second embodiment, the terminal contact spring 31 can be restricted to a predetermined compressed length by the spring compression holding portion 60, and therefore, when the plunger 21 slides in the press direction D1, the press amount of the plunger 21 until the terminal contact spring 31 makes contact with the terminals 41, namely, the press amount of the plunger 21 until the plunger 21 reaches the position of OP, does not vary between rots so that stable electrical conductivity can be obtained.

Further, as mentioned above, at the moment when the plunger 21 reaches the OP, the biasing force of the terminal contact spring 31, which holds the compression state, can be applied to the terminals 41 by the spring compression holding portion 60.

Accordingly, as illustrated in FIG. 9A, at the moment when the plunger 21 reaches the OP, the biasing force of the compressed terminal contact spring 31 can be fed back to the operator as the press load which is received by the operator.

Therefore, in the process where the operator presses the plunger 21, the terminal contact spring 31 and the terminals 41 are made to contact with each other, which enables the operator to perceive the fact that the switch 1A is actuated, so that the feeling of press operation can be enhanced.

The switch 1A of the second embodiment can additionally perform following functions and advantageous effects.

The terminal contact spring 31 is gradually enlarged in its diameter from the end portion on the return direction D2 side toward the press direction D1 so as to be formed as a conical shape, and therefore, the terminal contact spring 31 can be surely and easily held by the spring compression holding portion 60.

Figure 10A:
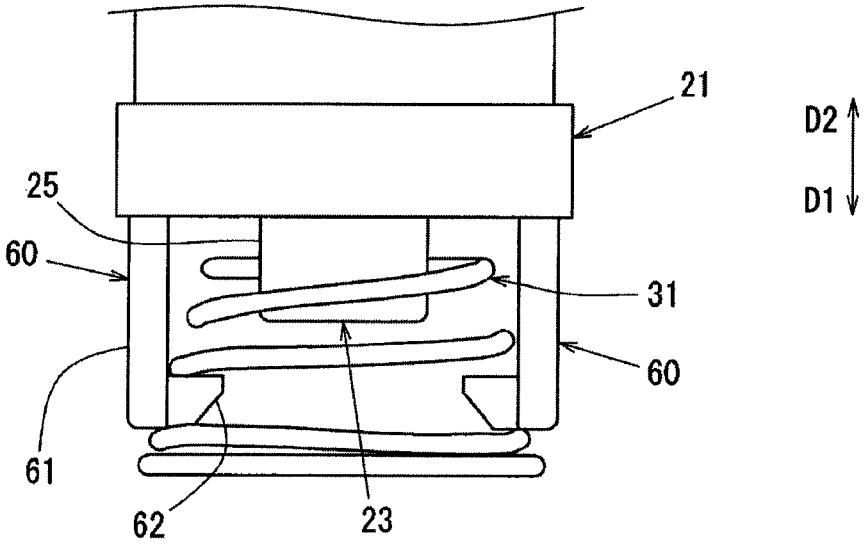
FIGS. 10A and 10B are operational explanatory diagrams of the switch according to the second embodiment.
Figure 10B:
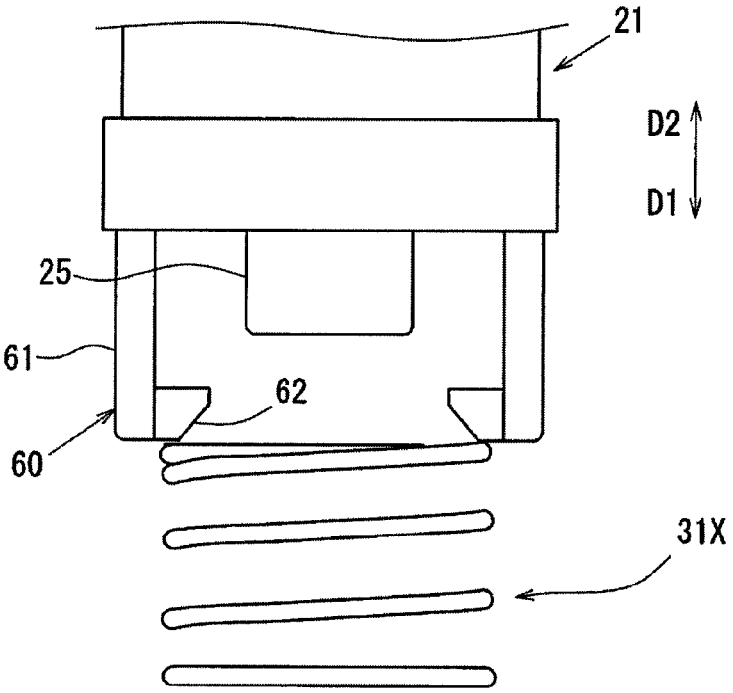

For details, for example, as illustrated in FIG. 10B, in the case that the cylindrical terminal contact spring 31X, which is formed so as to have the substantially same coil diameter along the length direction, is held at the spring compression holding portion 60, the end portion on the return direction D2 of the terminal contact spring 31X interferes with the engagement claw portion 62. Accordingly, there is a problem that the terminal contact spring 31X cannot be smoothly held by the spring compression holding portion 60.

On the other hand, as illustrated in FIG. 10A, in the case that the terminal contact spring 31, which is formed so as to have the conical shape, is held by the spring compression holding portion 60, the small diameter end portion side in the return direction D2 of the terminal contact spring 31 does not interfere with the engagement claw portion 62. Accordingly, the terminal contact spring 31 can be smoothly pressed in toward the spring mounting portion 23 side.

Accordingly, the engagement with the engagement claw portion 62 can be realized under the state in which the terminal contact spring 31 is guided by the spring tubular fitting portion 25.

Therefore, by forming the terminal contact spring 31 so as to be gradually enlarged in its diameter from the end portion in the return direction D2 toward the press direction D1 and have a conical shape, the terminal contact spring 31 can be surely and smoothly held by the spring compression holding portion 60.

Although the engagement allowable portion of this invention corresponds to the engagement groove 26 of this embodiment, and similarly, the engagement portion corresponds to the engagement side 32, this invention is not limited to the above-mentioned embodiment, and other various embodiments can be made.

Figure 11A:
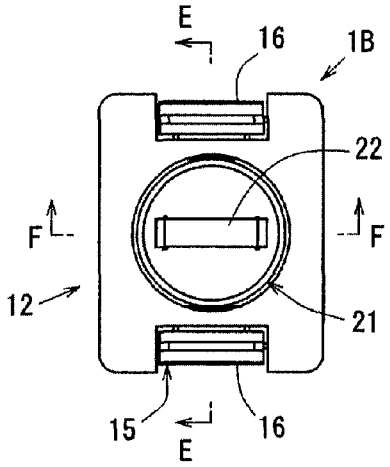
FIGS. 11A to 11C are constitutional explanatory diagrams of a switch according to another embodiment.
Figure 11B:
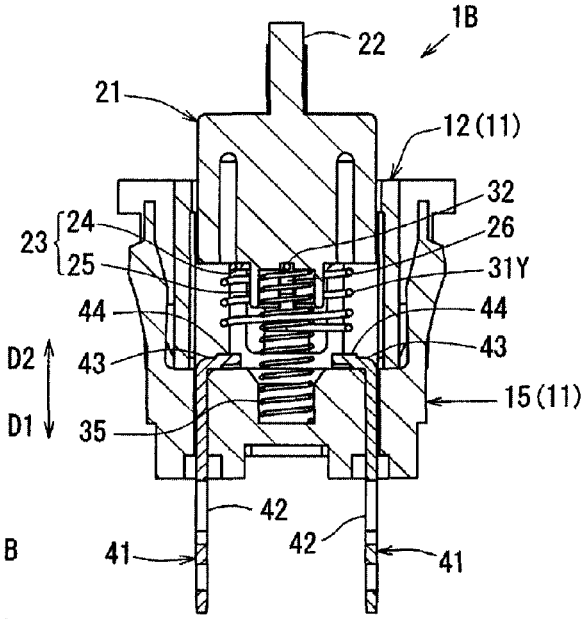
Figure 11C:
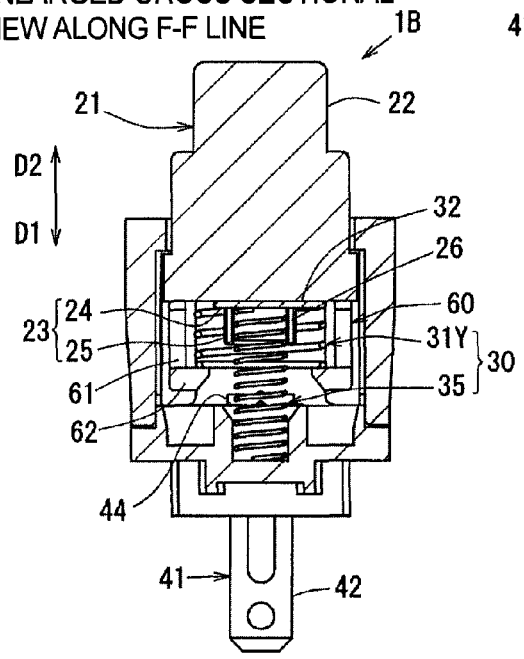

For example, the terminal contact spring is not limited to the conical shape, and can be formed as various constitutions, and as a terminal contact spring 31Y provided to a switch 1B illustrated in FIGS. 11A, 11B, and 11C, the terminal contact spring can be formed in a tubular shape which has the substantially same diameter along the axial direction of the spring.

Note that, FIG. 11A is a plan view of the switch 1B, FIG. 11B is an enlarged cross sectional view along the E-E line of FIG. 11A, and FIG. 11C is an enlarged cross sectional view along the F-F line in FIG. 11A.

There has thus been shown and described a switch which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch comprising:

a housing;

a plunger adapted to slide in a press direction or a return direction with respect to the housing;

a plurality of terminals adapted to be brought into a conductive state according to a predetermined position of the plunger; and two springs, one being a return spring adapted to bias the plunger in the return direction and to be compressed by a slide of the plunger in the press direction, and the other being a terminal contact spring adapted to make contact with the terminals so as to bring the terminals into a conductive state by the slide of the plunger in the press direction;

wherein the terminal contact spring is disposed so as to be compressed according to the slide of the plunger in the press direction under a contact state in which the terminal contact spring makes contact with the terminals, wherein an end portion on the return direction side of the terminal contact spring is provided with an engagement portion adapted to engage the terminal contact spring with the plunger in a circumferential direction, and the plunger is provided with an engagement allowable portion adapted to engage with the engagement portion, wherein an end portion on the press direction side of a wire, which constitutes the terminal contact spring, is disposed at a position so as to avoid contact with the terminals in a circumferential direction of the terminal contact spring, and wherein the engagement portion of the terminal contact spring is fixed under pressure to the plunger by the end portion on the return direction side of the return spring.

2. The switch according to claim 1, wherein a spring compression holding portion, which holds the terminal contact spring under a compressed state, is provided at the plunger.

3. The switch according to claim 2, wherein the terminal contact spring is configured so as to have an increasingly larger diameter from an end portion on the return direction side toward the press direction.

4. The switch according to claim 1, wherein the terminal contact spring is configured so as to have an increasingly larger diameter from an end portion on the return direction side toward the press direction.

5. A switch comprising:

a housing;

a plunger adapted to slide in a press direction or a return direction with respect to the housing;

a return spring adapted to bias the plunger in the return direction and to be compressed by a slide of the plunger in the press direction;

a plurality of terminals adapted to be brought into a conductive state according to a predetermined position of the plunger; and a terminal contact spring adapted to make contact with the terminals so as to bring the terminals into a conductive state by the slide of the plunger in the press direction;

wherein the terminal contact spring is disposed so as to be compressed according to the slide of the plunger in the press direction under a contact state of making contact with the terminals;

wherein an end portion on the return direction side of the terminal contact spring is provided with an engagement portion adapted to engage the terminal contact spring with the plunger in a circumferential direction, and the plunger is provided with an engagement allowable portion adapted to engage with the engagement portion;

wherein an end portion on the press direction side of a wire, which constitutes the terminal contact spring, is disposed at a position so as to avoid contact with the terminals in a circumferential direction of the terminal contact spring; and wherein the engagement portion of the terminal contact spring is fixed under pressure to the plunger by the end portion on the return direction side of the return spring.

* * * * *